United States Patent [19]

Noding

[11] Patent Number: 4,652,355

[45] Date of Patent: Mar. 24, 1987

[54] FLOW-THROUGH ELECTROLYTIC CELL

[75] Inventor: Stephen A. Noding, Brusly, La.

[73] Assignee: The Dow Chemical Company, Midland, Mich.

[21] Appl. No.: 776,178

[22] Filed: Sep. 13, 1985

[51] Int. Cl.[4] ..... C25B 9/00

[52] U.S. Cl. ..... 204/252; 204/263; 204/284; 204/291; 204/292; 204/294; 204/275; 429/225; 429/228; 428/307.3; 428/312.8; 428/318.4; 428/319.1

[58] Field of Search ..... 204/291, 292, 294, 284, 204/252, 275, 263; 428/307.3, 312.8, 318.4, 319.1; 429/225, 228

[56] References Cited

U.S. PATENT DOCUMENTS 4,188,268 2/1980 Sugahara et al. ..... 429/228

4,302,321 11/1981 De Nora et al. ..... 204/292

4,387,142 6/1983 Lindholm et al. ..... 424/228

*Primary Examiner*—R. L. Andrews

*Attorney, Agent, or Firm*—Dan R. Howard

[57] ABSTRACT

A flow-through electrochemical cell for sequentially oxidizing and reducing an aryl compound. The cell includes a cell body forming a compartment to hold an aqueous electrolyte solution, a porous anodic electrode, and a porous cathodic electrode. The anodic electrode includes a first porous layer of a hydrophobic material, a second porous layer with an oxidation catalyst dispersed therein, and a current collector in electrical contact with the second layer. The cathodic electrode comprises a block of a porous, electrically-conductive material impregnated with lead particles. The cell is particularly useful for the preparation of aryl hydroquinones at very high current efficiencies, high current densities, and low voltages.

12 Claims, 4 Drawing Figures

FLOW-THROUGH ELECTROLYTIC CELL

BACKGROUND OF THE INVENTION

The present invention relates to a flow-through electrolytic cell. More particularly, this invention relates to a flow-through cell utilizing porous anodic and cathodic electrodes for the preparation of aryl hydroquinones by the sequential oxidation and reduction of aryl compounds.

The synthesis of organic compounds by electrolysis is a relatively new technology. Electrolytic oxidation, reduction, and coupling of organic molecules have been carried out in the laboratory for more than a century, but only in the past fifteen to twenty years have organic chemicals been made on an industrial scale by electrochemical methods.

The proper combination of electrode and electrolyte is possibly the most important consideration for an organic electrochemical process. In electrochemical reductions, the cathode material may be critical in directing the electrochemistry toward the desired reaction products. Frequently, materials with high hydrogen-overvoltage such as lead, mercury, tin, zinc, cadmium, and graphite are required for satisfactory product selectivity and current efficiency. Because of its high hydrogen overpotential, lead is a potentially ideal cathode material for such processes. However, because lead has a low specific surface area and porosity, the principal; electrode reaction is usually hydrogen evolution. Increasing the specific surface area of a lead electrode would have an obvious advantage in this respect, but this advantage is usually limited by the rate of diffusion of the reacting species. It is therefore also important to have rapid movement of the electrolytic species through the electrode. To achieve mobility and efficient contact, small particles of lead could be uniformly distributed throughout a porous matrix. Some metals can be electrodeposited as small particles, but lead deposits as sheets or flakes, with preferential growth in the direction of the applied electric field. This anisotropic growth can be partially but not completely eliminated by electrodeposition from a solution containing a fluoroborate, silicofluoride, sulphamate, or pyrophosphate salt. Another possible technique would be the condensation of lead vapor in a porous matrix, but unfortunately the lead particles tend to form large aggregates on the surface of the matrix.

Known methods for the electrochemical oxidation or reduction of organic compounds include dissolving or suspending the organic compounds in an aqueous electrolyte solution, and passing the solution or suspension through an electrochemical cell. Such methods have the inherent disadvantage that the organic compounds may be at least partially oxidized to an oxidation level beyond that of the desired product, due primarily to the cell design. The product selectivity and current efficiency of such electrochemical methods may be lowered, and undesired by-products may be formed.

SUMMARY OF THE INVENTION

In generally, the present invention provides a flow-through electrochemical cell for sequentially oxidizing and reducing an aryl compound. The cell includes a cell body forming a compartment to hold an aqueous electrolyte solution, a porous anodic electrode, and a porous cathodic electrode. The anodic electrode includes a first foraminous or porous layer of a hydrophobic material, a second foraminous or porous layer with an oxidation catalyst dispersed therein, and a current collector in electrical contact with the aqueous electrolyte solution. The cathodic electrode comprises a block of a porous, electrically-conductive material impregnated with lead particles, and is positioned to provide contact with the aqueous electrolyte solution.

This invention also provides an electrochemical method for the preparation of aryl hydroquinones by the sequential oxidation and reduction of aryl compounds. As used herein, the term "aryl" is defined to include aromatic compounds, polynuclear aromatic compounds, substituted aromatic and polynuclear aromatic compounds, and derivatives thereof. The preparation of aryl hydroquinones by the method of this invention comprises the following steps:

(a) Disposing an aqueous electrolyte solution in a compartment of an electrochemical cell with the electrolyte solution contacting a cathodic and an anodic electrode. The anodic electrode includes a first foraminous or porous layer of a hydrophobic material, a second foraminous or porous layer with an oxidation catalyst dispersed therein, and a current collector in electrical contact with the second layer. The first layer is positioned to contact the aryl compound, and the second layer is positioned to contact the aqueous electrolyte solution. The cathodic electrode comprises a block of a porous, electrically-conductive material impregnated wtih lead particles.

(b) Transporting the aryl compound through the first hydrophobic layer to the second layer of the anodic electrode, while maintaining a pressure differential between the aqueous electrolyte and the aryl compound sufficiently low to prevent substantial bulk intermixing or flow through the electrode of the aryl compound and the aqueous electrolyte solution. A substantially uniform interface is thereby formed between the aryl compound and the aqueous electrolyte solution at the boundary between the first and second layers or in the second layer of the anodic electrode.

(c) Supplying an electrical current between the cathodic and anodic electrodes, thereby oxidizing the aryl compound to a quinone at the interface within the anodic electrode. The quinone diffuses through and away from the anodic electrode, and thereafter flows through the porous cathodic electrode, where it is reduced to a hydroquinone as it flows through the electrode.

(d) Removing the hydroquinone from the cell, and recovering the hydroquinone as the desired product.

In another aspect, the invention is a composition comprising a porous substrate, the substrate having distributed throughout therein lead particles having a maximum particle size of about 0.25 microns.

In another aspect, the invention is a process comprising: (a) contacting a solution of a lead salt with a porous substrate under conditions sufficient to deposit the lead salt into the porous substrate; (b) oxidizing the lead salt in situ to form an oxide of lead; and (c) reducing the lead oxide in situ under conditions sufficient to form lead particles within the pores of the substrate.

These and other aspects of the invention will be apparent to those skilled in the art from the foregoing description, and from the more detailed description which follows.

DETAILED DESCRIPTION OF THE INVENTION

Preferred aryl compounds include the unsubstituted and hydroxyl substituted aromatic compounds. Examples of preferred aryl compounds include benzene, naphthalene, phenol, and anthracene.

The supporting aqueous electrolyte solution preferably includes an acid, a salt, or a mixture of both. Preferably, the electrolyte solution is formed from an acid, and more preferably, the acid is an inorganic acid such as sulfuric acid. The most suitable concentration of the sulfuric acid electrolyte solution is between about three and about seven percent by weight, and the acid solution may be further saturated with lead sulfate to minimize the loss of lead dioxide from the anode electrode. Preferably, acid and salt are employed together in the electrolyte. Lead salts are preferred. Preferably, the anion of the salt is the same as the anion of the dissociated acid. The acid preferably is employed in an amount such that the pH of the electrolyte solution is less than about 3.

The electrolyte cell can be operated at any combination of temperature and pressure at which the reaction will proceed. Typically, the cell temperature is between the freezing point of the electrolyte solution and the decomposition temperatures of the organic components of the process. Preferably, the reaction is carried out at less than about 40° C. Ambient pressure and temperature are preferred for the sake of convenience.

The improved electrodes employed in the process for converting aryl compounds allow the process to run with low voltage and high current. This combination of electrical conditions is fast, highly efficient, and results in low electrical costs while giving high yields of the desired products. Preferably, the process is operated using at least about 100 milliamps per square inch of anode surface area (>15 milliamps/cm$^2$).

For the purposes of the present invention the term aryl hydroquinone refers to hydroquinone itself as well as other hydroxyaromatic compounds produced by the process of the present invention for electrochemically converting aryl compounds.

DESCRIPTION OF THE PREFERRED EMBODIMENTS

The following description illustrates the manner in which the principles of this invention are applied, but is not to be construed as in any sense limiting the scope of the invention.

Figure 1:
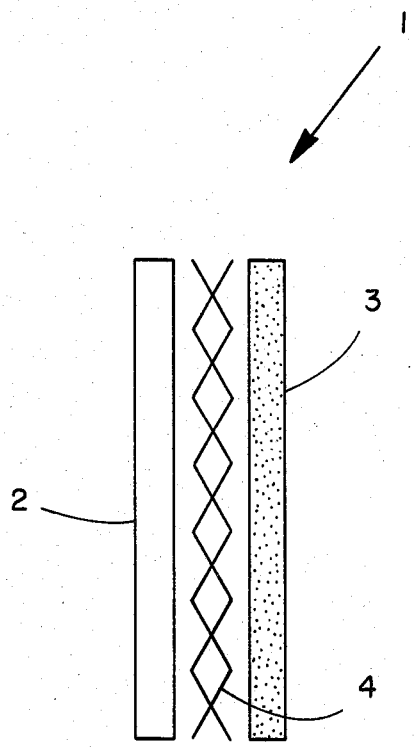
FIG. 1 is a schematic representation of an anodic electrode made in accordance with the principles of the present invention.

More specifically, in FIG. 1 schematically represents an anodic electrode 1 made in accordance with the principles of the present invention. The electrode 1 is formed of a first foraminous or porous layer 2 of a hydrophobic material, a second foraminous or porous layer 3 which includes an oxidation catalyst, and a current collector 4 which provides electrical contact with the second layer 3. In FIG. 1 the current collector 4 is shown as disposed between the first and second layers 2 and 3. Alternatively, the current collector 4 may be positioned behind the first layer 2 or in front of the second layer 3. A detailed description of the anodic electrode 1 and of its fabrication is included in U.S. Pat. No. 4,464,236 to Noding, hereby incorporated by reference.

Figure 2:
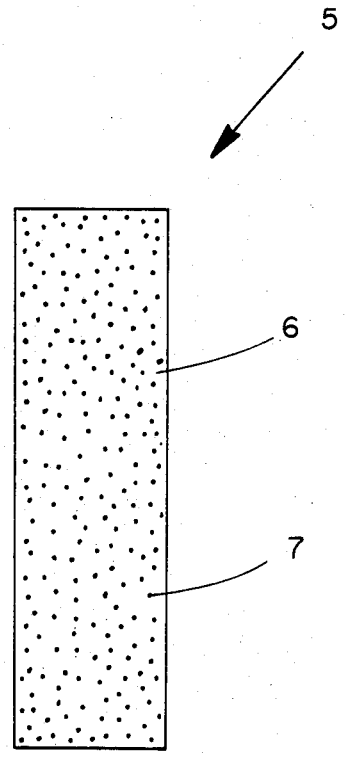
FIG. 2 is a schematic representation of a cathodic electrode made in accordance with the principles of the present invention.

FIG. 2 illustrates a cathodic electrode 5 made in accordance with the principles of the present invention. The flow-through porous cathode 5 comprises a block 6 of a porous, electrically-conductive material impregnated with lead particles 7. Preferably, the block 6 is a porous graphite block.

The diameter of the lead particles is preferably less than about one fourth of a micron, it being understood that by "diameter" is meant the average width of the particle, which need not be spherical. Even more preferably, the concentration of lead in the graphite matrix is between about two and about two and one-half grams per cubin inch. The resistivity of the cathodic electrode 5 preferably is between about three and about three and one-half milliohm-inches. The pore diameter preferably is between about four and about four and one half mils (100–115 microns), it again being understood that the term "diameter" in no sense implies sphericity. The specific surface area of the electrode 5 preferably is between about two and about two and one-half square meters per gram.

Figure 3:
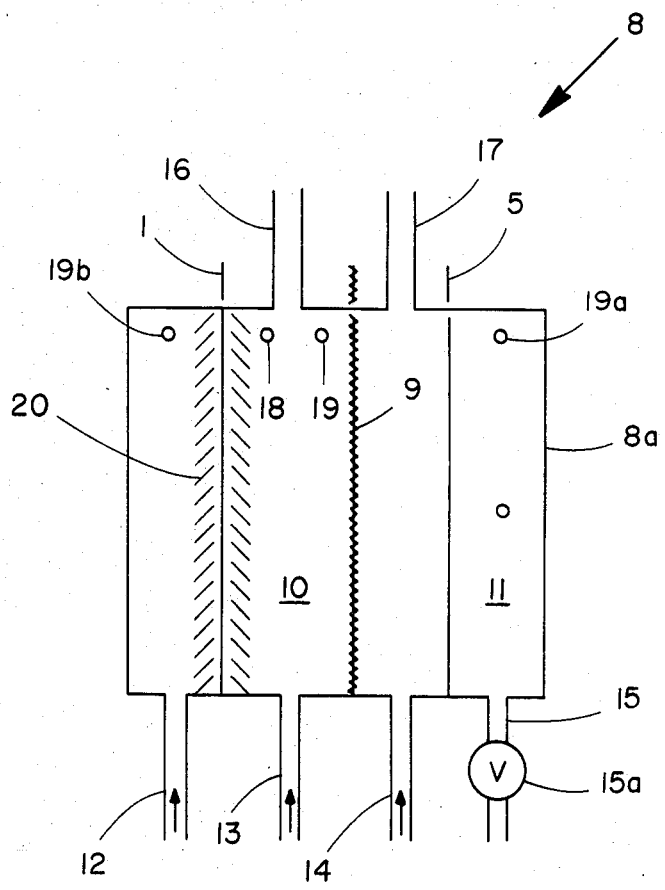
FIG. 3 is a schematic representation of an electrochemical cell made in accordance with the principles of the present invention.

The flow-through electrochemical cell of the present invention will now be described with reference to FIG. 3, in which the electrochemical cell is designated generally by the numeral 8. The cell 8 comprises a cell body 8*a* and a partition 9 which divides the cell body 8*a* into anode and cathode compartments 10 and 11, respectively. The anodic electrode 1 and the anolyte are disposed in the anode compartment 10, and the cathodic electrode 5 and the catholyte in the cathode compartment 11. The anodic electrode 1 is beneficially reinforced and supported by a pair of titanium screens 20. The cell 8 is provided with inlets 12, 13, and 14, and with outlets 15, 16, 17, 19, 19*a*, and 19*b*. The cell 8 is further provided with a reference electrode 18, which is preferably a saturated calomel electrode, and with a valve 15*a* for draining the cell 8.

The inlets 12, 13, and 14 are supplied by recycle systems which will be described hereinafter. Inlet 12 is for the aryl compound to be electrolyzed, inlet 13 for the anolyte, and inlet 14 for the catholyte. Outlet 15 is for the electrochemical product formed by sequential oxidation and reduction at the anodic and cathodic electrodes 1 and 5, respectively. Outlet 16 is for gas (oxygen or carbon dioxide) evolved at the anodic electrode 1, and outlet 17 for gas (hydrogen) evolved at the cathodic electrode 5. Outlet 19*b* feeds the aryl-compound recycling system, outlet 19*a* the catholyte recycling system, and outlet 19 the anolyte recycling system.

The partitition 9 may be a porous membrane, but is preferably an ion-exchange membrane. More preferably, the partition 9 is a cation-exchange membrane. Even more preferably, the partition 9 is made from a resin which includes the sodium salt of poly(tetrafluoroethylene persulfonic acid). Most preferably, the partition 9 is made from a poly(tetrafleuroethylenepersulfonic acid) resin manufactured and sold by E. I. duPont de Nemours and Company under the trademark "NAFION 324".

Figure 4:
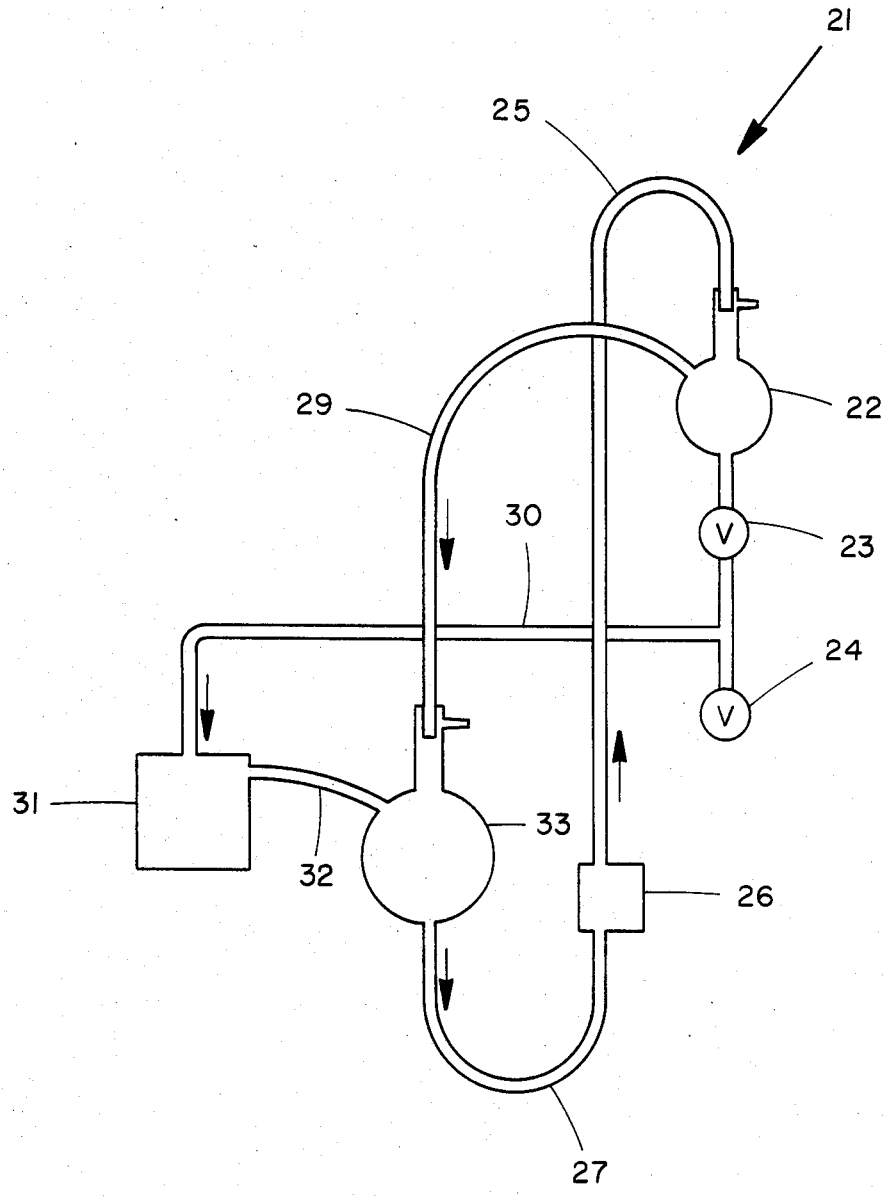
FIG. 4 is a schematic representation of a recycle system made in accordance with the principles of the present invention.

Apparatus for recycling the aryl compound, the anolyte, and the catholyte is shown in FIG. 4, where a recycle system suitable for these components is designated by the numeral 21. The recycle system 21 includes an upper reservoir 22, a lower reservoir 33, an intermediate chamber 31, and a circulating pump 26. The lower reservoir 33 is connected to the upper reservoir 22 by an overflow line 29, to the chamber 31 by a return line 32, and to the pump 27 by a first connecting line 27. The pump is connected to the upper reservoir by a second connecting line 25. The upper reservoir 22 is connected by a first valve 23 and a feed line 30 to the chamber 31. The direction of flow within the recycle system is indicated by arrows. Drainage for the system 21 is provided by a second valve 24. The entire system 21 may be pressurized to provide a pressure differential between the electrochemical cell 8 and the recycle system 21.

The method of the present invention for the electrochemical production of hydroquinones will now be described in detail. The aryl compound which is to be converted to the hydroquinone is added to the portion of the anode compartment 10 between the anodic electrode 1 and the wall of the cell body 8*a*. An aqueous electrolyte solution is added to the compartment 11 and to the remaining portion of the anode compartment 10. The electrolyte may, for example, be an aqueous solution of sulfuric acid, which beneficially may be saturated with lead sulfate. By maintaining the level of the aryl compound or a solution thereof aproximately six inches above the level of the electrolyte, the aryl compound or solution thereof is induced to diffuse through the first layer 2 and into the second layer 3 without causing bulk flow through the anodic electrode 1 or bulk mixing of the electrolyte and the aryl compound or solution thereof. As current passes through the cell 8, oxidation occurs at the resulting interface between the electrolyte and the aryl compound or solution thereof.

In one embodiment of the present method, the quinone formed within the anodic electrode diffuses into the anolyte, through the partition 9, and into the cathode compartment 11 and catholyte. The quinone and the catholyte then flow through the porous cathodic electrode 5, where the quinone is reduced to a hydroquinone as it flows through the electrode 5. In a second embodiment, a portion of the anolyte containing the quinone is transferred, for example by pumping, from the anode compartment 10 to the cathode compartment 11. In both of these embodiments reduction to the hydroquinone occurs as the electrolyte and the quinone flow through the porous cathodic electrode 5. A third embodiment includes recycling the aryl compound or solution thereof, the anolyte, and/or the catholyte.

The invention will now be illustrated by the following examples, which are intended to demonstrate the principles upon which the invention is based, but are in no sense to be construed as limiting the scope of the invention.

EXAMPLE 1

PREPARATION OF CATHODIC ELECTRODE

A porous cathodic electrode 5 is prepared from a 3"×4"×3/16" porous grahpite block 6. The edges and surfaces of the block 6 are smoothed with a file. The dust is removed by a nitrogen stream directed onto the block 6. A ⅛" hole is drilled through one corner of the block 6. A strand of 24-gauge copper wire four inches in length is looped through the hole, and is twisted until almost tight. Using an oxygen-butane torch or a soldering gun and a ½"×¼"×1/16" sheet of lead, the hole is filled with molten lead to form a conductive contact between the copper wire and the graphite block 6.

In a 600-milliliter beaker are placed a magnetic stirring bar, approximately 500 milliliters of a saturated aqueous lead nitrate solution, the graphite block 6, and a 3"×4"×1/16" lead sheet. A 5"×5"×¼" sheet of poly(vinyl chloride) with two ¼"×4" slots is placed on top of the beaker. The top portions of the graphite block and lead sheet are adjusted through the slots in the cover, and are secured with alligator clips. The beaker is then placed on a magnetic stirrer-heater.

The saturated lead nitrate solution is heated with stirring to between forty-five and fifty-five °C. The alligator clips attached to the graphite block 6 and lead sheet are connected to a galvanostat as the anode and cathode, respectively. To insure that a 3"×3" area of the block 6 is covered by the lead nitrate solution, the position of the block 6 is adjusted or more lead nitrate solution is added as required. A current of nine hundred milliamperes, corresponding to a current density of one hundred milliamperes per square inch, is passesd through the block 6 for one hour. The block 6 is then removed from the beaker, is washed thoroughly with deionized water, and is dried in an oven at 130° C. for an hour. After cooling to room temperature, the block 6 is weighed to determine the loading of lead dioxide. The foregoing procedure is repeated as necessary until the desired loading was obtained.

In a 600-milliliter beaker are placed a magnetic stirring bar and five hundred milliliters of five percent by weight sulfuric acid. The graphite block 6, which is now uniformly impregnated with lead dioxide, and the lead sheet are arranged through the slots in the poly(vinyl chloride) sheet are and placed on top of the beaker as previously described. The position of the graphite block 6 or the amount of surfuric acid solution is adjusted to cover at least nine square inches of the block 6 with the acid. The graphite block 6 and the lead sheet are connected to a galvanostat as cathode and anode respectively. A current of nine hundred milliamperes is passed through the block for three hours. The electrolysis, is carried out at room temperature with stirring. After electrolysis, the graphite block 6, which is now impregnated with lead particles 7, is removed, is washed thoroughly with deionized water, is dried at 130° C. for an hour, and is weighed to determine the loading of the now-formed electrode 5.

In carrying out the foregoing preparation, it is important that the lead dioxide and lead metal be uniformly distributed throughout the porous graphite block 6. The electrode 5 preferably has no appreciable concentration gradient of lead from the outside surface ot the interior of the block. By way of example, a porous cathode 5 as prepared by the method just described is found to have a surface concentration of four thousand lead particles per square millimeter and a concentration in the center of the block of three thousand lead particles per square millimeter of surface area.

It will be noted that two washing operations or steps are included in the above-described method for preparing the porous cathode 5. While either or both of these steps may be omitted, it is preferable that both be included. In particular, it is desirable that the lead-impregnated electrode 5 be washed free of soluble lead salts before being used in an electrochemical process. Otherwise, there can be an induction period after the current has been turned on before the electrode 5 becomes fully functional, efficient, and selective. The induction period will continue until the residual lead salts have been reduced to metallic lead.

EXAMPLE 2

PREPARATION OF HYDROQUINONE FROM BENZENE

Using the apparatus shown in FIGS. 1–4 and the method previously described, benzene is converted to hydroquinone. The electrolyte solution is a five percent by weight solution of sulfuric acid in water saturated with lead sulfate. The current density is one hundred milliamperes per square inch, the anode potential one and one-half volts versus a saturated calomel electrode, the cathode potential 1.1 volts versus the saturated calomel electrode, and the cell potetential between 2.6 and 2.9 volts. The anodic and cathodic current efficiencies are ninety and one hundred percent, respectively. The hydroquinine is separated from the catholyte by vacuum crystallization, and the electrolyte solution is recycled to the cathode compartment.

EXAMPLE 3

PRODUCTION OF NAPHTHOHYDROQUINONE FROM NAPHTHALENE

Using essentially the same procedure and apparatus as in Example 2, naphthalene as a fifteen percent by weight solution in hexane is sequentially oxidized to naphthoquinone and is reduced to naphthohydroquinone. Since naphthohydroquinone is very susceptible to oxidation by air, a nitrogen purge is used to maintain an inert atmosphere over the entire cathode compartment. The yield to naphthoquinone and to naphthohydroquinone (naphthalene diol) is essentially quantitative.

EXAMPLE 4

PREPARATION OF HYDROQUINONE FROM PHENOL

Using essentially the same procedure and apparatus as in Example 2, phenol as a three-and-one-half weight percent solution in benzene is oxidized to parabenzoquinone, with an eighty-percent current efficiency. The intermediate quinone is then reduced to hydroquinone at an approximately one-hundred percent current efficiency.

EXAMPLE 5

PREPARATION OF HYDROQUINONE FROM PHENOL

Using essentially the same procedure and apparatus as in Example 2, phenol as a three-weight-percent solution in n-hexane is converted to hydroquinone, with an anodic current efficiency of eight-five percent and a cathodic current efficiency of approximately one hundred percent.

EXAMPLE 6

PREPARATION OF HYDROQUINONE FROM PHENOL

Using essentially the same procedure and apparatus as in Example 2, phenol as a three-weight-percent solution in methylene chloride is converted to hydroquinone at an eighty-two percent anodic current efficiency and an approximately one hundred percent cathodic current efficiency.

Examples 2–6 illustrate the high current efficiency which is characteristic of this invention. This high current efficiency, characteristic of the present invention but uncharacteristic of the prior art, provides a definition of the invention in terms of current efficiency. Thus, the invention may in one aspect be defined as an electrochemical process for preparing aryl hydroquinones by sequentially oxidizing and reducing aryl compounds in a flow-through electrolytic cell under conditions which produce the aryl hydroquinones at overall current efficiencies of at least about fifty percent. Preferably, the process has a current efficiency of at least about 75 percent, more preferably at least about 90 percent, and most preferably at least about 95 percent.

A second important feature of the invention that is illustrated by Examples 2–6 is the low voltage required for the process of the invention. This low voltage is very important as an energy-conserver, since the electrical power is equal to the mathematical product of the current and the applied voltage. Hence, for any given current, a lower voltage means a smaller power consumption. A third characteristic illustrated by the examples is the high current densities that can be used without significant reduction in current efficiency. This feature is also important since, for a given current efficiency, the rate of production of the desired product is directly proportional to the current density.

While certain representative embodiments and details have been shown for the purpose of illustrating the present invention, it will be apparent to those skilled in the art that various changes and modifications can be made therein without departing from the spirit and scope of the invention.

What is claimed is:

1. A flow-through electrochemical cell for sequentially oxidizing and reducing an aryl compound, the cell comprising: a cell body forming a compartment to hold an aqueous electrolyte solution; a porous anodic electrode including a first foraminous or porous layer of a hydrophobic material, a second foraminous or porous layer with an oxidation catalyst dispersed therein, and a current collector in electrical contact with the second layer, the second layer positioned to provide contact with the aqueous electrolyte solution; and a porous cathodic electrode comprising a block of a porous, electrically-conductive material impregnated with lead particles, the cathodic electrode positioned to provide contact with the aqueous electrolyte solution.

2. The electrochemical cell of claim 1, wherein the oxidation catalyst dispersed in the second layer of the anodic electrode is finely-divided lead dioxide.

3. The electrochemical cell of claim 1, wherein the second layer of the anodic electrode is a composite mixture of between about six and about ninety-five percent lead dioxide, and between about five and about forty percent poly(tetrafluoroethylene) by weight.

4. The electrochemical cell of claim 1, wherein the porous electrically-conductive material in the cathodic electrode is graphite, and the diameter of the lead particles is less than about one fourth of a micron.

5. The electrochemical cell of claim 1, wherein the pore diameter of the cathodic electrode is between about four and about four and one-half mils.

6. The electrochemical cell of claim 1, wherein the concentration of lead in the cathodic electrode is between about two and about two and one-half grams per cubic inch.

7. The electrochemical cell of claim 1, further comprising: a partition to separate the electrolyte into anolyte and catholyte; and recycle means for the aryl compound, the anolyte, and the catholyte.

8. The electrochemical cell of claim 7, wherein the partition comprises an ion-exchange membrane formed with a resin which includes the sodium salt of poly-tetrafluoroethylene perfluorosulfonic acid).

9. An electrode comprising a porous substrate, the substrate having distributed throughout therein lead particles having a maximum particle size of about 0.25 microns.

10. The electrode of claim 9 wherein the porous substrate has a pore size of from about four to about four and one-half mils.

11. The electrode of claim 9 wherein the substrate comprises a block of a porous, electrically-conductive material.

12. The electrode of claim 11 wherein the substrate is porous graphite.

* * * * *